US005892185A

United States Patent [19]

Takahashi et al.

[11] Patent Number: 5,892,185

[45] Date of Patent: Apr. 6, 1999

[54] SPEAKER UNIT AND A METHOD FOR MANUFACTURING THE SAME

[75] Inventors: Osamu Takahashi; Hideyuki Murakami; Kunio Mitobe, all of Yamagata-ken, Japan

[73] Assignees: Pioneer Electronic Corporation, Tokyo; Tohoku Pioneer Electronic Corporation, Yamagata-ken, both of Japan

[21] Appl. No.: 864,724

[22] Filed: May 28, 1997

[30] Foreign Application Priority Data

May 28, 1996 [JP] Japan ..... 8-133550

[51] Int. Cl.[6] ..... G10K 13/00

[52] U.S. Cl. ..... 181/171; 181/172

[58] Field of Search ..... 181/171, 172, 181/173; 381/193, 202, 205

[56] References Cited

U.S. PATENT DOCUMENTS

| | | | |
|---|---|---|---|
| 4,752,963 | 6/1988 | Yamazaki et al. | 381/193 |
| 4,799,266 | 1/1989 | Sakamoto et al. | 381/193 |
| 5,157,731 | 10/1992 | Mitobe | 381/202 |

*Primary Examiner*—Khanh Dang
*Attorney, Agent, or Firm*—Nikaido Marmelstein Murray & Oram, LLP

[57] ABSTRACT

A speaker unit has a cylindrical yoke, an annular frame secured to the yoke, and a diaphragm having a central spherical vibrating portion and an annular support portion formed around the vibrating portion and mounted on the annular frame. An annular vertical holding wall is formed on the annular frame, and an annular vertical abutment portion is formed on the annular support portion and abutted against the annular vertical holding wall.

4 Claims, 3 Drawing Sheets

SPEAKER UNIT AND A METHOD FOR MANUFACTURING THE SAME

BACKGROUND OF THE INVENTION

The present invention relates to a speaker unit, and more particularly to a loudspeaker unit for a type of loudspeakers called a dome speaker, wherein a diaphragm is accurately positioned with respect to a speaker frame.

There is known a speaker unit for a dome loudspeaker.

Referring to FIG. 2, a conventional dome speaker has a cylindrical yoke 1 having an upper opening, and an annular speaker frame 2 attached to the yoke 1 on the upper periphery thereof. A magnet 3 such as a permanent magnet is securely mounted in the yoke 1 and a diaphragm 4 is mounted over the speaker frame 2.

The diaphragm 4 comprises a central spherical vibrating portion 5, inner cylindrical portion 6 connected to the base of the spherical portion 5, an outer cylindrical portion 7 formed by upwardly turning the bottom edge of the inner cylindrical portion 6, and an outwardly extending support portion 8 bent at the upper edge of the outer cylindrical portion 7. A voice coil 9 is mounted in an annular gap between cylindrical portions 6 and 7, while maintaining a gap 10 between the coil 10 and the inner periphery of the outer cylindrical portion 7. The supporting portion 8 is securely attached to the speaker frame 2. The diaphragm 4 is formed by molding a resin film with a press. The portion between the outer cylindrical portion 7 and the supporting portion 8 is upwardly bulged to form a semicircle in section.

The speaker frame 2 made of a thermoplastic synthetic resin has an integral annular shoulder 11 formed on the inner periphery thereof. The supporting portion 8 of the diaphragm 4 is securely attached to the shoulder 11 with an adhesive so that the diaphragm 4 is securely mounted on the frame 2.

When excited, the voice coil 9 generates an electromagnetic force in the axial direction thereof, that is, in the upward direction toward the upper edge of the sheet of the figure, thereby vibrating the diaphragm 4. Hence sound is emanated from the spherical portion 5 of the diaphragm 4. Although speaker units for dome speakers which vary in detail are known, each has the same basic construction as described above.

When assembling the speaker unit, it is essential that the center of the spherical portion 5, that is the center of the inner cylindrical portion 6, coincides with the center of the speaker frame 2, that is the center of a magnetic circuit. When the centers do not coincide with each other, the inside wall of the cylindrical portion 6 contacts with the magnet 3 because of rolling of the diaphragm 4, thereby emanating mechanical noises other than electrical signal sounds, such as scratch noise, causing a defect in the product. Hence it is necessary to accurately position the diaphragm 4 in the speaker unit at assembling.

Referring to FIG. 3, in a conventional assembling method, when mounting the diaphragm 4 on the speaker frame 2, the outer edge of the supporting portion 8 is made to slide on a vertical inner wall 12 which is extended from the shoulder 11. More particularly, the diaphragm 4 is formed with a mold and then the outer periphery thereof is cut out with a die to form an entire edge, so that the diameter of the supporting portion 8 conforms to the inner diameter of the vertical wall 12. Thus by sliding the outer edge of the supporting portion 8 along the vertical wall 12, the diaphragm 4 can be positioned.

However, the positioning by the conventional method may not be sufficiently accurate. Namely, since the molding and the cutting out of the diaphragm 4 are made in different processes, a center O5 of the spherical portion 5 and a center O8 of the supporting portion 8 may be deflected from one another as shown in FIG. 4. Such an deflection causes the inner wall of the inner cylindrical portion 6 to contact with the magnet 3, emitting the above described noises.

In order to solve the problem, there is proposed a structure shown in FIG. 5, which is actually put into use.

Referring to FIG. 5, an annular rib 13 is provided on the supporting portion 8 to form an engaging recess on the underside thereof. The shoulder 11 of the speaker frame 2 has an annular projection 14 which is adapted to engage with the recess of the rib 13. Since the rib 13 is formed at the same time with the molding of the diaphragm 4, the rib 13 is shaped coaxially with the diaphragm. Thus, when the rib 13 engages with the projection 14, the diaphragm 4 is accurately positioned so that the center of the diaphragm coincides with the center of the voice coil 9 around the inner cylindrical portion 6.

In such a structure, since it is necessary to form the rib 13 on the supporting portion 8 and the projection 14 on the shoulder 11, the widths in the radial direction thereof are increased, thereby preventing reduction of the size of the loudspeaker as a whole. The materials for the diaphragm 4 and the speaker frame 2 are also increased, so that the structure is undesirable from the point of the manufacturing cost.

SUMMARY OF THE INVENTION

An object of the present invention is to provide a speaker unit and a method for manufacturing the same, wherein the diaphragm is accurately and easily mounted on the speaker frame without increasing the dimensions of the elements thereof.

According to the present invention, there is provided a speaker unit having a cylindrical yoke, an annular frame secured to the yoke, and a diaphragm having a central spherical vibrating portion and an annular support portion formed around the vibrating portion and mounted on the annular frame, comprising, an annular vertical holding wall formed on the annular frame, and an annular vertical abutment portion formed on the annular support portion and abutted against the annular vertical holding wall.

An annular shoulder is further formed on an upper edge of the annular vertical holding wall, outwardly expanding from the upper edge, and an annular stopper portion formed on an upper edge of the abutment portion and mounted on the annular shoulder.

The present invention further provides a method for manufacturing a speaker unit having a cylindrical yoke, an annular frame secured to the yoke, and a diaphragm having a central spherical vibrating portion and an annular support portion formed around the vibrating portion and mounted on the annular frame, the steps comprising, forming an annular vertical holding wall formed on the annular frame, forming an annular vertical abutment portion on the annular support portion at the same time as forming of the central spherical vibrating portion and the support portion, and mounting the diaphragm on the annular frame, abutting the annular vertical abutment portion against the annular vertical holding wall.

These and other objects and features of the present invention will become more apparent from the following detailed description with reference to the accompanying drawings.

DETAILED DESCRIPTION OF THE PREFERRED EMBODIMENT

Figure 1:
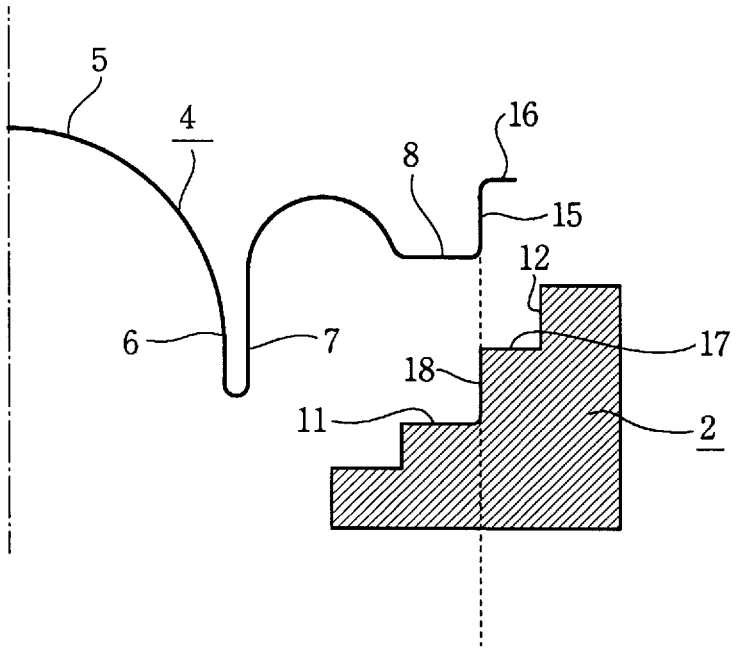
FIG. 1 is a sectional view showing one half of a speaker unit for a dome loudspeaker according to the present invention.

An embodiment of the present invention will be described hereinafter with reference to FIG. 1. The reference numerals as those in FIGS. 2 to 5 designate the same parts in FIG. 1 and the detailed descriptions thereof are omitted.

The diaphragm 4 is further provided with an annular vertical abutment portion 15, vertically extending upward from the entire outer edge of the supporting portion 8. The upper edge of the vertical abutment portion 15 is further extended and bent outward to form an annular stopper portion 16. A plurality of gaps in the circumferential direction may be formed in the vertical abutment portion 15 and the stopper portion 16.

The vertical portion 15 is simultaneously formed as the diaphragm 4 is molded from a resin film. Thus the vertical portion 15 is not deflected from the center of the spherical portion 5.

The speaker frame 2 is provided with a second annular shoulder 17 projected from the shoulder 11, so that an annular vertical holding wall 18 having a substantially same diameter of the peripheral wall of the annular vertical abutment portion 15 is formed. When the diaphragm 4 is mounted on the frame 2, the vertical abutment portion 15 abuts against the vertical holding wall 18 while the stopper portion 16 engages with the shoulder 17. Thus, the center of the spherical portion 5, that is the center of the inner cylindrical portion 6, and the center of the speaker frame 2, that is the center of the magnet accurately coincide with each other.

The widths of the supporting portion 8 and the speaker frame 2 in the radial directions thereof need not be increased. Hence the diameter of the loudspeaker can be decreased.

Figure 2:
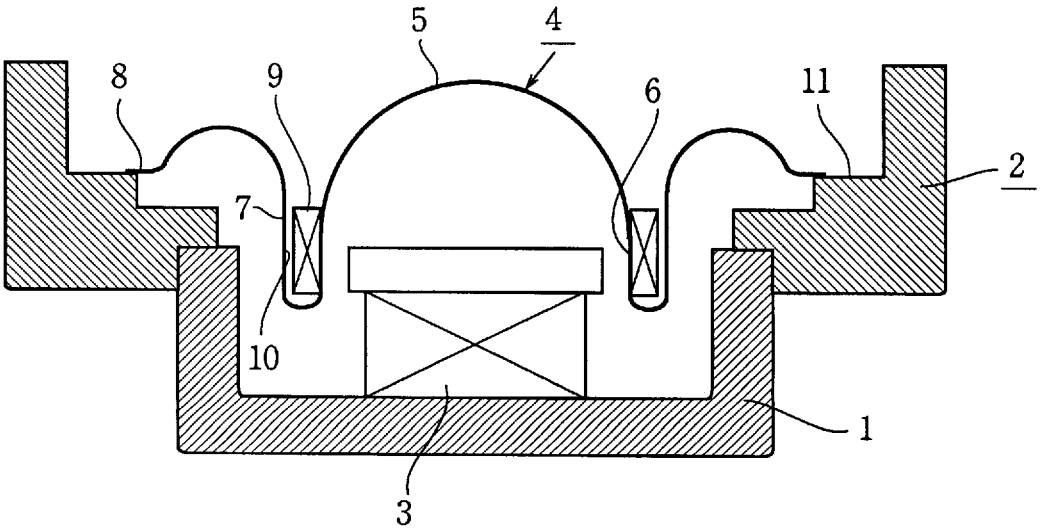
FIG.2 PRIOR ART
FIG. 2 is a sectional view of a conventional speaker unit.
Figure 3:
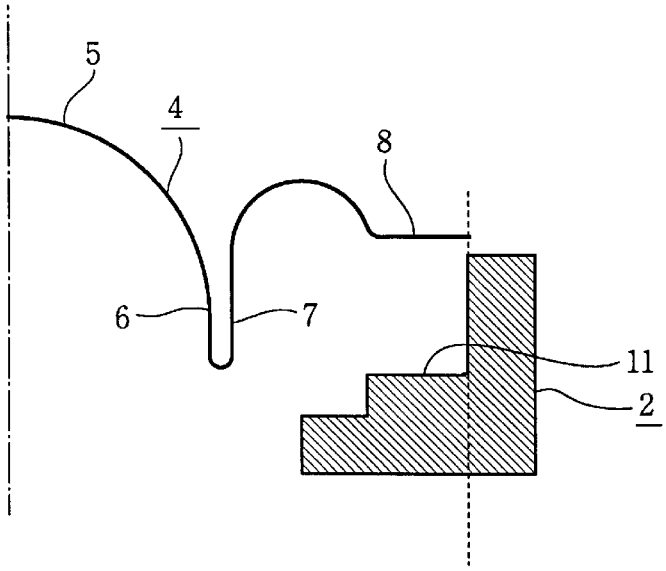
FIG.3 PRIOR ART
FIG. 3 is a sectional view showing a structure for positioning the elements in the conventional speaker unit of FIG. 2.
Figure 4:
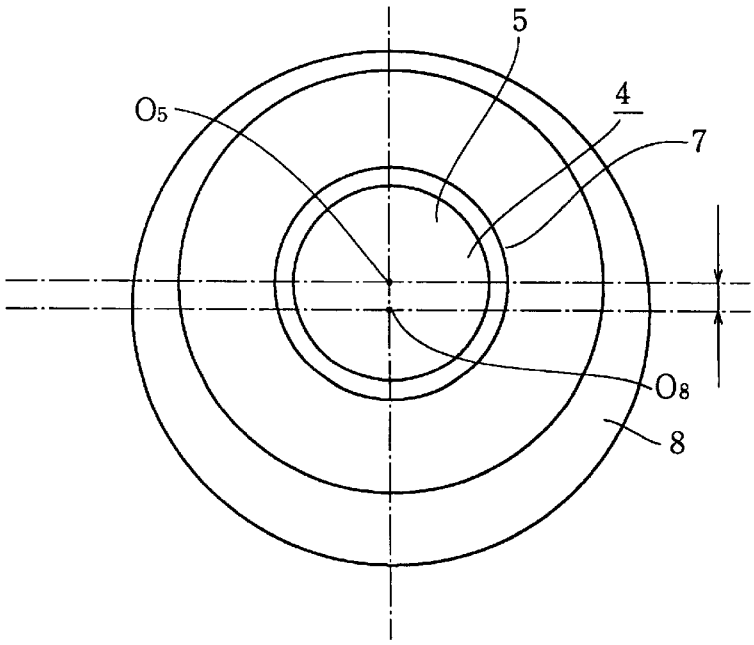
FIG.4 PRIOR ART
FIG. 4 is a diaphragm explaining a deflection of the centers of the members in the conventional speaker unit.
Figure 5:
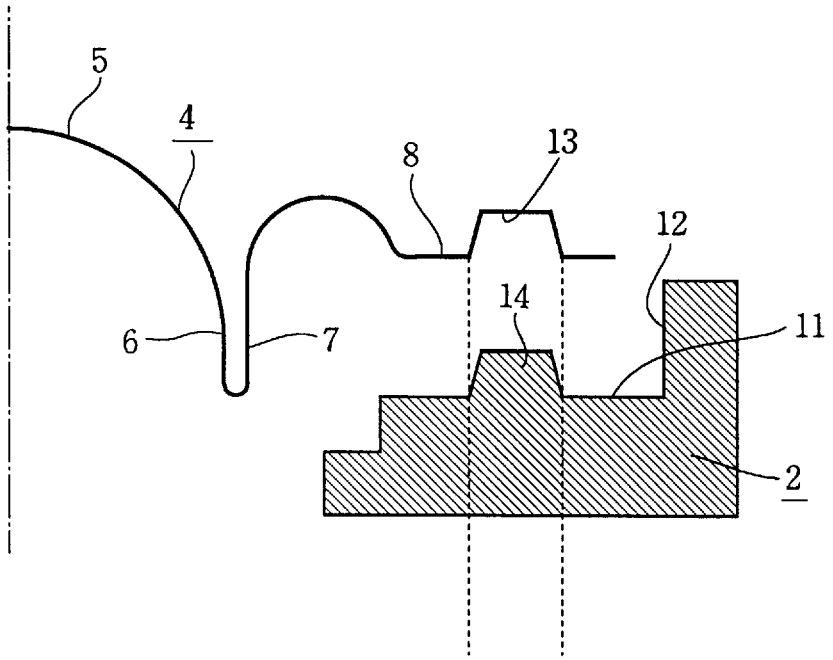
FIG.5 PRIOR ART
FIG. 5 is a sectional view showing one half of another example of the conventional speaker unit.

The present invention may be applied to a speaker unit having a speaker frame without the second shoulder 17 as shown in FIGS. 2 and 3. The diameters of the diaphragm 4 and the speaker frame 2 in the radical directions thereof can be reduced in the modification so that the reduction in the size of the loudspeaker can be further enhanced. The present invention may further be so modified that the stopper portion 16 is removed.

In accordance with the present invention, the deflection between the centers of the spherical portion and the supporting portion of the diaphragm is prevented. When such a diaphragm is mounted on the speaker frame, the center of the spherical portion accurately coincides with the center of the magnet of the speaker unit. Since the speaker unit of the present invention does not cause increase in the size of the diaphragm and the frame in the radial direction thereof, the entire loudspeaker incorporating the speaker unit can be reduced in size.

While the invention has been described in conjunction with preferred specific embodiment thereof, it will be understood that this description is intended to illustrate and not limit the scope of the invention, which is defined by the following claims.

What is claimed is:

1. A speaker unit having a cylindrical yoke, an annular frame secured to the yoke, and a diaphragm having a central spherical vibrating portion and an annular support portion formed around the vibrating portion and mounted on the annular frame, comprising:

an annular vertical holding wall formed on the annular frame;

an annular vertical abutment portion formed on the annular support portion and abutted against the annular vertical holding wall;

an annular shoulder formed on an upper edge of the annular vertical holding wall, outwardly expanding from the upper edge; and an annular stopper portion formed on an upper edge of the abutment portion and mounted on the annular shoulder.

2. The speaker unit according to claim 1 further comprising another annular shoulder formed on a bottom edge of the annular vertical holding wall, inwardly and downwardly expanding from the bottom edge, and said annular support portion mounted on the another annular shoulder.

3. A method for manufacturing a speaker unit having a cylindrical yoke, an annular frame secured to the yoke, and a diaphragm having a central spherical vibrating portion and an annular support portion formed around the vibrating portion and mounted on the annular frame, the steps comprising:

forming an annular vertical holding wall on the annular frame;

forming an annular vertical abutment portion on the annular support portion and an annular stopper portion on an upper edge of the abutment portion at the same time as forming of the central spherical vibrating portion and the support portion;

forming an annular shoulder formed on an upper edge of the annular vertical holding wall; and mounting the diaphragm on the annular frame, abutting the annular vertical abutment portion against the annular vertical holding wall.

4. A method according to claim 3, further comprising the steps of forming another annular shoulder on a bottom edge of the annular vertical holding wall inwardly and downwardly extending from the bottom edge; and mounting said annular support portion on another annular shoulder.

* * * * *